US006854393B2

(12) United States Patent
Hazan

(10) Patent No.: US 6,854,393 B2
(45) Date of Patent: Feb. 15, 2005

(54) SOFT REMOVABLE THERMAL SHIELD FOR A MISSILE SEEKER HEAD

(75) Inventor: Nisim Hazan, Kiryat Motzkin (IL)

(73) Assignee: Rafael-Armament Development Authority Ltd., Haifa (IL)

( * ) Notice: Subject to any disclaimer, the term of this patent is extended or adjusted under 35 U.S.C. 154(b) by 0 days.

(21) Appl. No.: 10/681,905

(22) Filed: Oct. 10, 2003

(65) Prior Publication Data

US 2005/0000384 A1 Jan. 6, 2005

(30) Foreign Application Priority Data

Oct. 17, 2002 (IL) ..... 152362

(51) Int. Cl.[7] ..... F42B 10/00
(52) U.S. Cl. ..... 102/501
(58) Field of Search ..... 102/501

(56) References Cited

U.S. PATENT DOCUMENTS 3,559,928 A * 2/1971 Dohmeyer ..... 244/121
3,576,298 A * 4/1971 Barnett et al. ..... 244/162
3,601,055 A * 8/1971 Crockett ..... 102/377
3,644,222 A * 2/1972 Fleming ..... 528/110
3,866,226 A * 2/1975 Benneche et al. ..... 342/9
4,100,322 A * 7/1978 Seibold et al. ..... 442/136
4,173,187 A * 11/1979 Steverding ..... 250/515.1
4,242,964 A * 1/1981 Warren et al. ..... 102/275
4,275,859 A * 6/1981 Bleday ..... 244/121
4,724,738 A * 2/1988 Johnson ..... 89/1.809
4,753,169 A * 6/1988 Shores ..... 102/293
4,867,357 A * 9/1989 Inglis et al. ..... 244/121
5,125,600 A * 6/1992 Brumbaugh ..... 244/158 A
5,167,386 A * 12/1992 Laquer et al. ..... 244/158 R
5,217,185 A * 6/1993 Rucker ..... 244/121
5,325,784 A * 7/1994 Bai et al. ..... 102/293
5,340,058 A * 8/1994 Holl et al. ..... 244/117 A
5,457,471 A * 10/1995 Epperson, Jr. ..... 343/872
5,547,628 A * 8/1996 Lacombe et al. ..... 264/621
5,985,405 A * 11/1999 Doucette et al. ..... 428/86
6,136,418 A * 10/2000 Martin et al. ..... 428/195.1
6,227,494 B1 * 5/2001 Turner ..... 244/158 R
6,394,394 B1 * 5/2002 Raun et al. ..... 244/158 R
6,679,453 B2 * 1/2004 Steiner ..... 244/121
2003/0089821 A1 * 5/2003 Miralles et al. ..... 244/49

* cited by examiner

*Primary Examiner*—Teri P. Luu
*Assistant Examiner*—Jordan Lofdahl
(74) *Attorney, Agent, or Firm*—Mark M. Friedman

(57) ABSTRACT

A soft removable thermal shiled for protecting a heat-sensitive element of a projectile. The shield includes a main body and an attachment arrangement forconnecting the main body to the projectile. The main body is designed to cover part of a window of the projectile, behind which the element is disposed. The main body is designed also to thermally protect the element during part of the flight of the projectile, and to be soft enough when released from the projectile, so that the main body does not harm the projectile after it is released.

9 Claims, 4 Drawing Sheets

SOFT REMOVABLE THERMAL SHIELD FOR A MISSILE SEEKER HEAD

FIELD AND BACKGROUND OF THE INVENTION

The present invention relates to a thermal shield and, in particular, it concerns a soft removable thermal shield for a seeker head of a guided missile.

By way of introduction, some guided missiles have an internal seeker head which is disposed behind a window, which is located at the nose of the missile. Typically, the seeker head and often the window itself are sensitive to heat exposure, which is caused by friction of the missile body with air during supersonic or hypersonic flight. This heat exposure can result in breakage to the window and damage to the seeker head. Additionally, the seeker head is typically not used for the entire flight, but only during the terminal phase of the flight. Therefore, the window of the missile should be covered by a thermal protector during the first phases of the flight while the seeker head is not used.

One prior art thermal protector is a rigid thermal protector which covers the window during the first phases of the flight and which is retracted from the window during the terminal phase of the flight. A shortcoming of this thermal cover is its cost and mechanical complexity.

Another prior art thermal protector is a rigid thermal protector which covers the window during the first phases of the flight and which is released completely from the missile at the beginning of the terminal phase of the flight. This thermal cover is less costly and mechanically simpler than the first prior art thermal cover. A shortcoming of this thermal cover is that when this thermal cover is released it may hit the real part of the missile, thereby causing damage to the missile.

There is therefore a need for an inexpensive thermal shield for a missile seeker that does not damage the missile when released.

SUMMARY OF THE INVENTION

The present invention is a soft removable thermal shield for a guided missile seeker head and a method of operation thereof.

According to the teachings of the present invention there is provided, a soft removable thermal shield for protecting a heat-sensitive element of a projectile, comprising: (a) a main body configured to: (i) cover at least part of a window of the projectile, the element being disposed behind the window; (ii) thermally protect the element during at least part of a flight of the projectile; and (iii) be sufficiently soft upon being released from the projectile during the flight that the main body is substantially harmless to the projectile after being released; and (b) an attachment arrangement for releasably connecting the main body to the projectile.

According to a further feature of the present invention the main body includes an ablative material.

According to a further feature of the present invention the ablative material is ablative rubber.

According to a further feature of the present invention, there is also provided: (c) a reinforcement of the main body.

According to a further feature of the present invention the reinforcement includes at least one layer of textile fabric.

According to a further feature of the present invention, there is also provided: (c) a protective layer that is disposed adjacent to the window when the main body is operationally connected to the projectile, wherein a coefficient of friction between the protective layer and the window is sufficiently low to allow the main body to release substantially easily from the window and to leave the window substantially clean of a residue of the main body.

According to a further feature of the present invention the protective layer includes at least one layer of glass fiber fabric.

According to a further feature of the present invention the attachment arrangement includes at least one cord, the at least one cord having two ends, one of the ends being configured for attachment to the main body, and another of the ends being configured for attachment to the projectile.

According to a further feature of the present invention the attachment arrangement includes at least one cord, the at least one cord having two ends and a middle section, at least part of the middle section being mechanically connected to the main body, each of the two ends being configured for attachment to the projectile.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is a soft removable thermal shield construction and method of operation thereof.

The principles and operation of the soft removable thermal shield according to the present invention may be better understood with reference to the drawings and the accompanying description.

Figure 1:
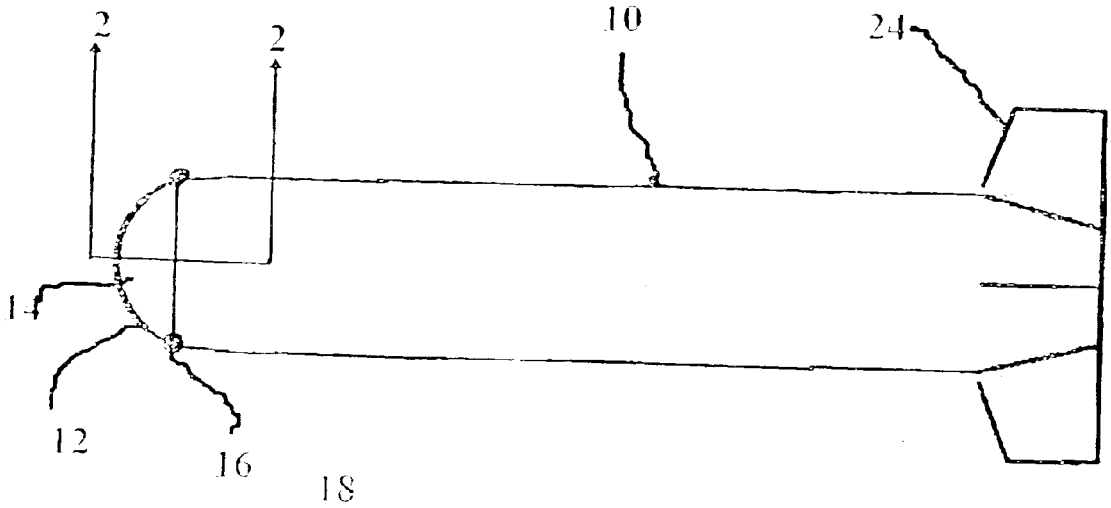
FIG. 1 is a schematic view from above of a missile having a soft removable thermal shield disposed thereon that is constructed and operable in accordance with a preferred embodiment of the invention.
Figure 2:
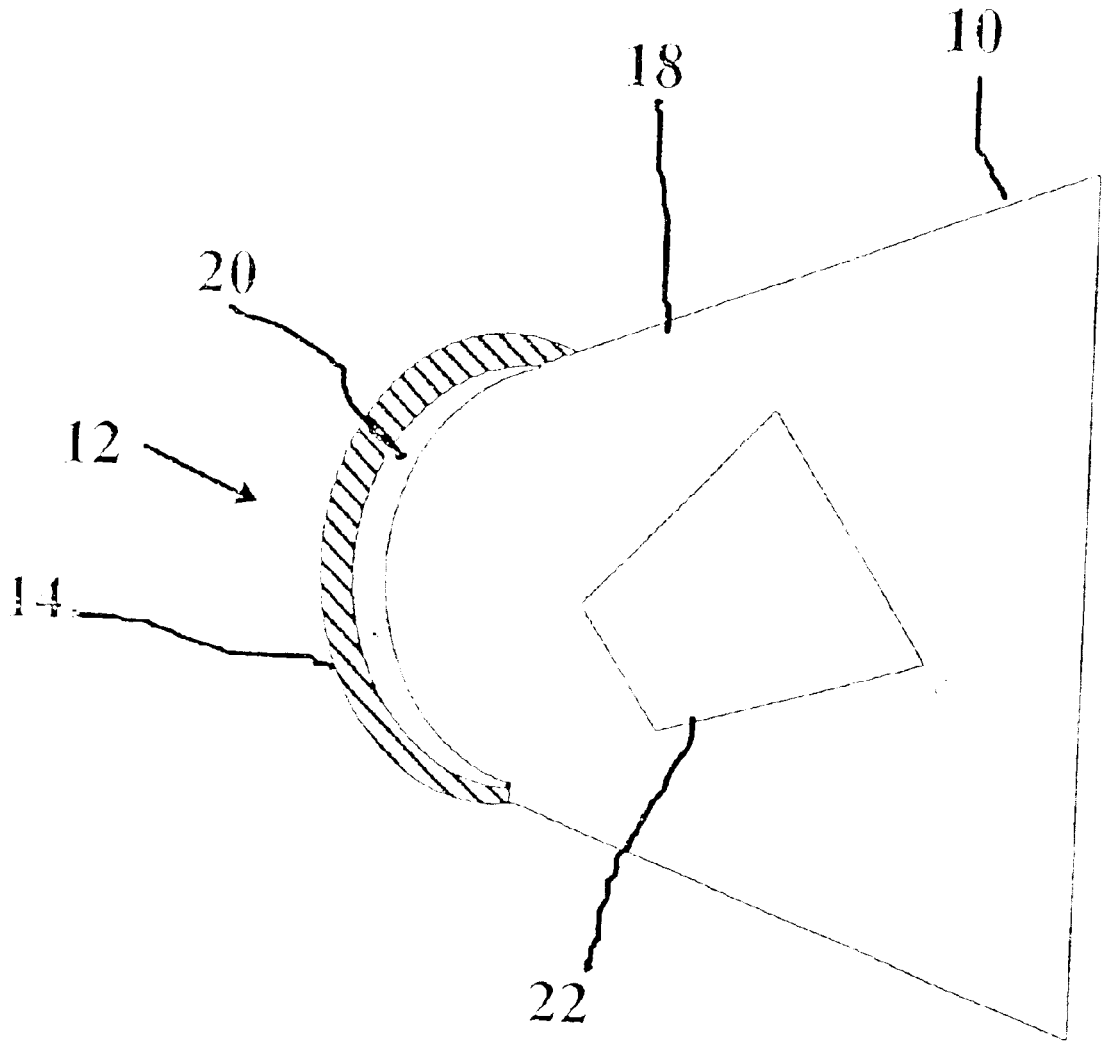
FIG. 2 is a cross-sectional view taken along line 2—2 of FIG. 1.

Reference is now made to FIG. 1 and FIG. 2. FIG. 1 is a schematic view from above of a horizontally flying projectile 10, specifically a guided missile, having a soft removable thermal shield 12, disposed on the nose section 18 thereof, that is constricted and operable in accordance with a preferred embodiment of the present invention. FIG. 2 is a cross-sectional view taken along line 2—2 of FIG. 1. Thermal shield 12 has a main body 14 and an attachment arrangement 16. Nose section 18 includes a window 20. Within projectile 10 and behind window 20 is an element 22, for example a seeker head, which is sensitive to thermal exposure. Main body 14 is configured to cover window 20 and to thermally protect element 22 and window 20 during the initial part of the flight of projectile 10. Main body 14 is also configured to be sufficiently soft, upon release from projectile 10 during the flight, that main body 14 is substantially harmless to projectile 10 after being released. The softness of main body 14 takes into account the relative velocities of main body 14 and projectile 10 after the release of main body 14 from projectile 10. In particular main body 14 is substantially harmless to the tail section 24 of projectile 10. In accordance with a preferred embodiment of the present invention main body 14 is inherently soft. In accordance with a most preferred embodiment of the present invention main body 14 is initially relatively rigid but becomes soft during the flight, for example, by being formed from an ablative material such as ablative rubber whereby main body 14 is thick and hard at the beginning of the flight but enough of main body 14 ablates during the flight so that main body 14 is soft when released. It should be noted that an ablative material, such as ablative rubber, provides thermal protection to element 22 and window 20, as the ablative material absorbs heat by ablating. Attachment arrangement 16 is configured to operationally connect main body 14 and projectile 10 prior to the release.

Figure 3:
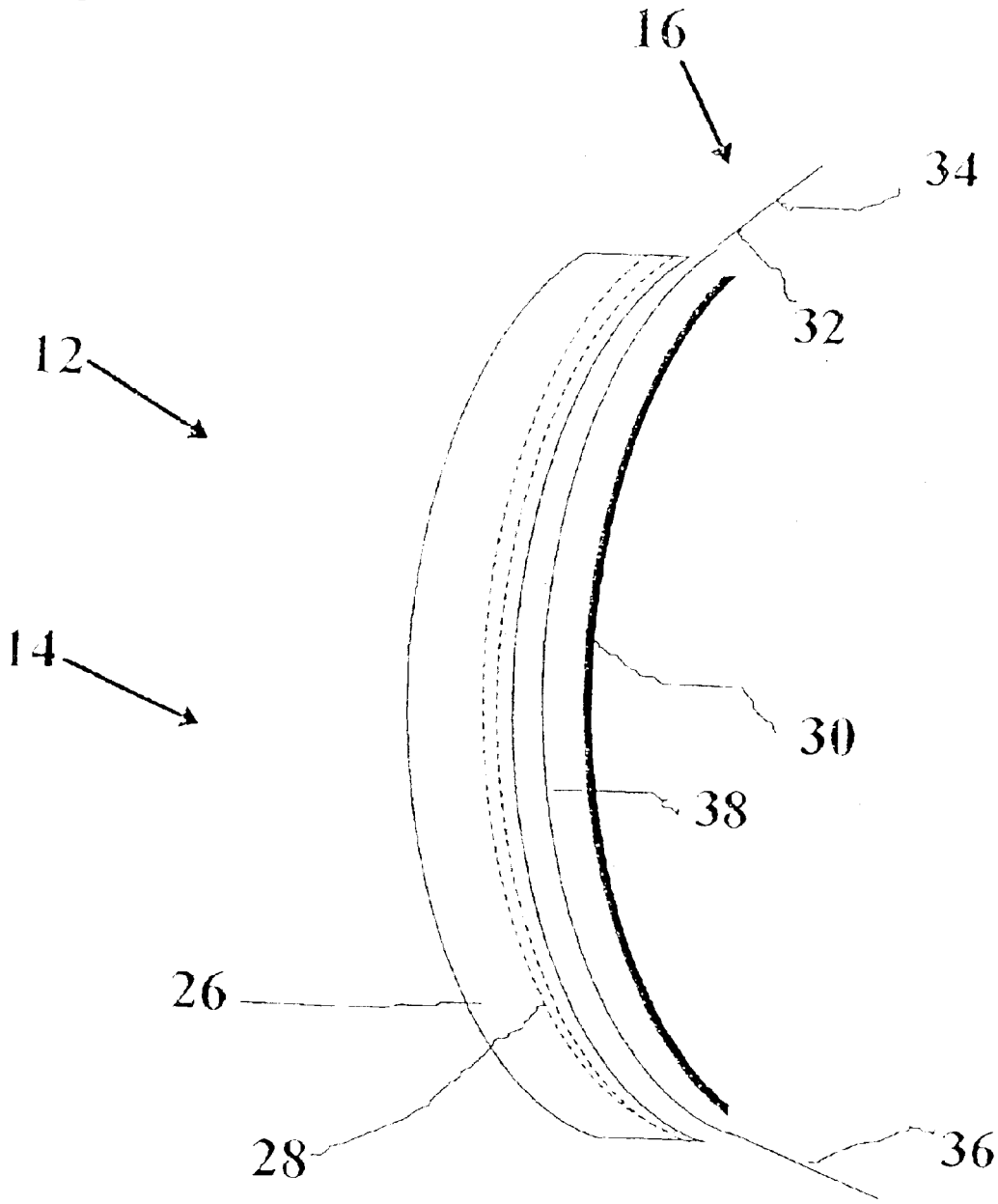
FIG. 3 is a detailed cross-sectional view of a main body and an attachment arrangement of the thermal shield of FIG. 1.

Reference is now made to FIG. 3, which is a detailed cross-sectional view of main body 14 and projectile 10 of thermal shield 12 of FIG. 1. Main body 14 typically includes an outer layer 26 of reinforced ablative material, typically ablative rubber, which is reinforce by one or more layers 28 of textile fabric. Outer layer 26 faces away from window 20 when main body 14 is operationally connected to projectile 10. Therefore outer layer 26 and reinforcement layers 28 provide a flexible, soft thermal protection. In accordance with a preferred embodiment of the present invention, thermal shield 12 also includes at least one protective layer 30, typically formed from glass fiber fabric. Protective layer 30 forms an inner layer of main body 14, such that, protective layer 30 is disposed adjacent to window 20 when main body 14 is operationally connected to projectile 10. The coefficient of friction between protective layer 30 and window 20 is sufficiently low to allow main body 14 of thermal shield 12 to release substantially easily from window 20 and to leave window 20 substantially clean from a residue of main body 14. Attachment arrangement 16 includes at least one cord 32. In accordance with a most preferred embodiment of the present invention, cord 32 has two ends 34, 36 and a middle section 38. Part of middle section 38 is mechanically connected to main body 14, typically by sandwiching middle section 38 between layers 28 and protective layer 30. End 34 and end 36 are configured for attachment to projectile 10. Methods of attaching attachment arrangement 16 to projectile 10 and releasing therefrom are known to those skilled in the art.

Figure 4:
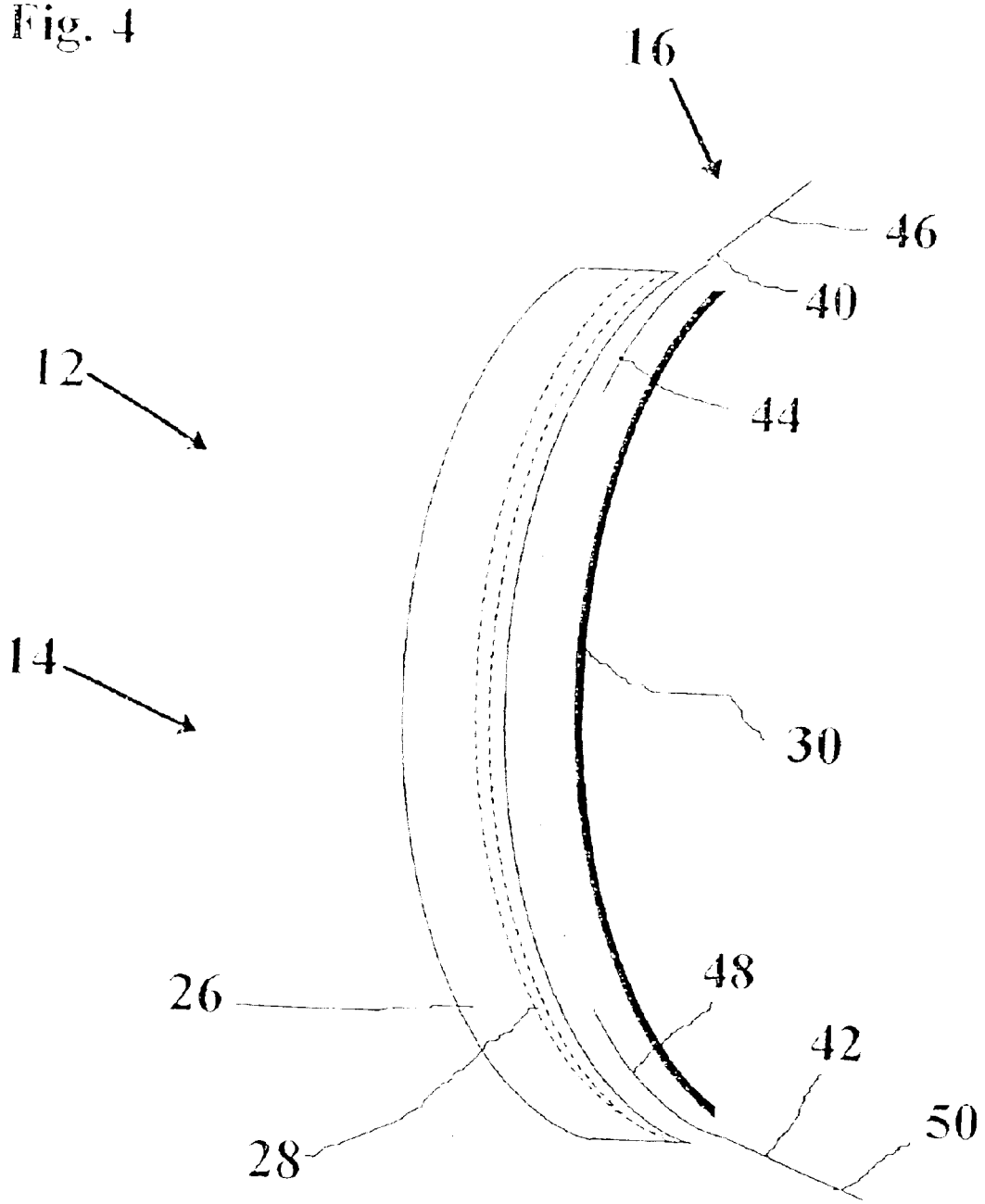
FIG. 4 is a detailed cross-sectional view of a main body and an alternate attachment arrangement of the thermal shield of FIG. 1.

Reference is now made to FIG. 4, which is a detailed cross-sectional view of main body 14 and an alternate attachment arrangement 16 of thermal shield 12 of FIG. 1. In accordance with an alternate preferred embodiment of the present invention, attachment arrangement 16 has at least two cords 40, 42. Cord 40 has two ends 44, 46. Cord 42 has two ends 48, 50. Ends 44, 48 are mechanically connected to main body 14, typically by sandwiching ends 44, 48 between layers 28 and protective layer 30. End 46 and end 50 are configured for attachment to projectile 10.

It will be appreciated by persons skilled in the art that the present invention is not limited to what has been particularly shown and described hereinabove. Rather, the scope of the present invention includes both combinations and subcombinations of the various features described hereinabove, as well as variations and modifications thereof that are not in the prior art which would occur to persons skilled in the art upon reading the foregoing description.

What is claimed is:

1. A soft removable thermal shield for protecting a heat-sensitive element of a projectile, comprising:

(a) a main body configured to:

(i) cover at least part of a window of the projectile, the element being disposed behind said window;

(ii) thermally protect the element during at least part of a flight of the projectile; and (iii) be sufficiently soft upon being released from the projectile during said flight that said main body is substantially harmless to the projectile after being released; and (b) an attachment arrangement for releasably connecting said main body to the projectile, such that a release of said main body from the projectile is at least partially non-ablative.

2. The thermal shield of claim 1, wherein said main body includes an ablative material.

3. The thermal shield of claim 2, wherein said ablative material is ablative rubber.

4. The thermal shield of claim 1, further comprising:

(c) a reinforcement of said main body.

5. The thermal shield of claim 4, wherein said reinforcement includes at least one layer of textile fabric.

6. The thermal shield of claim 1, further comprising:

(c) a protective layer that is disposed adjacent to said window when said main body is operationally connected to the projectile, wherein a coefficient of friction between said protective layer and said window is sufficiently low to allow said main body to release substantially easily from said window and to leave said window substantially clean of a residue of said main body.

7. The thermal shield of claim 6, wherein said protective layer includes at least one layer of glass fiber fabric.

8. The thermal shield of claim 1, wherein said attachment arrangement includes at least one cord, said at least one cord having two ends, one of said ends being configured for attachment to said main body, and another of said ends being configured for attachment to the projectile.

9. The thermal shield of claim 1, wherein said attachment arrangement includes at least one cord, said at least one cord having two ends and a middle section, at least part of said middle section being mechanically connected to said main body, each of said two ends being configured for attachment to the projectile.

* * * * *